US007172854B2

(12) United States Patent
Kuse

(10) Patent No.: US 7,172,854 B2
(45) Date of Patent: Feb. 6, 2007

(54) PHOTOGRAPHIC COLOR DEVELOPER SOLUTION AND PROCESSING METHOD BY USE THEREOF

(75) Inventor: Satoru Kuse, Hino (JP)

(73) Assignee: Konica Minolta Photo Imaging, Inc. (JP)

( * ) Notice: Subject to any disclaimer, the term of this patent is extended or adjusted under 35 U.S.C. 154(b) by 34 days.

(21) Appl. No.: 10/980,924

(22) Filed: Nov. 3, 2004

(65) Prior Publication Data

US 2005/0100834 A1 May 12, 2005

(30) Foreign Application Priority Data

Nov. 10, 2003 (JP) ..... 2003-380042

(51) Int. Cl.
*G03C 7/407* (2006.01)
*G03C 7/413* (2006.01)

(52) U.S. Cl. ..... 430/467; 430/468; 430/357; 430/435

(58) Field of Classification Search ..... 430/467, 430/468, 357, 435
See application file for complete search history.

(56) References Cited

U.S. PATENT DOCUMENTS 4,997,749 A * 3/1991 Wernicke et al. ..... 430/464
5,063,143 A * 11/1991 Hirose et al. ..... 430/419
5,063,144 A * 11/1991 Wernicke ..... 430/436
5,466,565 A * 11/1995 Shigemori et al. ..... 430/444

FOREIGN PATENT DOCUMENTS

| | | |
|---|---|---|
| EP | 330-035 | 8/1989 |
| EP | 0 468 781 A1 | 1/1992 |
| EP | 0 621 507 A1 | 10/1994 |

* cited by examiner

*Primary Examiner*—Hoa Van Le
(74) *Attorney, Agent, or Firm*—Lucas & Mercanti, LLP

(57) ABSTRACT

A color developer solution is disclosed, comprising p-phenylenediamine type color developing agents, wherein 2% to 35% by weight of the p-phenylenediamine color developing agents is accounted for by a N-hydroxyalkyl-substituted p-phenylenediamine color developing agent, and the color developer solution further comprising a compound represented by the following formula (1) or (2):

formula (1)

formula (2)

.

9 Claims, No Drawings

PHOTOGRAPHIC COLOR DEVELOPER SOLUTION AND PROCESSING METHOD BY USE THEREOF

FIELD OF THE INVENTION

The present invention relates to a color developer solution for use in silver halide color photographic materials and a processing method by use thereof, and in particular to a color developer solution exhibiting an improved precipitation property, achieving stable processing characteristics even in a small quantity work and improving staining in edge portions, and a processing method by use thereof.

BACKGROUND OF THE INVENTION

Processing for silver halide color photographic material (hereinafter, also denoted simply as photographic material) is basically comprised of two steps of color development and desilvering, in which the desilvering is further comprised of bleaching and fixing steps. In addition, a washing, there is also included a washing, rinsing or stabilizing step is also included.

In the stage of color development, exposed silver halide is reduced to silver and a simultaneously oxidized color developing agent is reacted with a coupler to form a dye. In this process, halide ions resulting from reduction of silver halide is dissolved out into a color developer solution and accumulated therein. In the stage of desilvering, silver resulting from color development is oxidized (or bleached) by an oxidizing agent (or bleaching agent) and subsequently, the whole of silver salts is removed by a fixing agent in the form of a soluble salt from a photographic material. There is also known a combined bleaching and fixing process (or bleach-fixing process).

Recently, color processing trends toward rapid access from the needs for digitization and low replenishment in view of global environment protection, and accordingly, high-active processing has been desired. To achieve the high-active processing, there are known a method in which development accelerators such as benzyl alcohol are used, a method in which processing is performed at a relatively high temperature of a color developing solution, a method in which the concentration of a color developing agent is increased, and a method in which stirring in color processing is strengthened. However, these methods include various problems. Thus, the use of a development accelerator such as benzyl alcohol actually increases an environmental load, processing at a relatively high temperature of a color developing solution markedly increases oxidation or evaporation of a color developer solution, having no suitability for low-volume processing, increasing the concentration of a color developing agent produces problems such as deposition of the color developing agent, and strengthening stirring in color processing often results in oxidation of a color developer solution or physical flaws of a photographic material.

There is described, for example, in JP-B Nos. 6-75178 and 6-75179-(hereinafter, the term JP-B refers to Japanese Patent Publication) a technique of the use of a N-hydroxyalkyl-substituted p-phenylenediamine type color developing agent in the combination with color developing agents. However, rapid processability in this color developing step is a level of 120 to 150 sec., which is not a technique for achieving rapid processing of less than 60 sec. Moreover, it was also proved that this technique involved such a problems that staining caused by penetration of a color developing agent easily occurred in the edge portion of color print paper. Specifically when processed in low-volume, this problem not only became marked but there was also produced a problem that it was difficult to maintain sufficient process stability.

SUMMARY OF THE INVENTION

Accordingly, it is an object of the present invention is to provide a color developer solution used for photographic material, exhibiting an improved precipitation property, achieving stable processing characteristics (specifically, yellow maximum density) even in a small quantity work and improving staining in edge portions, and a processing method by use thereof. It is another object of the invention is to provide a color developing solution exhibiting superior rapid processability and a processing method by use thereof.

In one aspect the present invention is directed to a color developer solution comprising a p-phenylenediamine type color developing agent, wherein 2% to 35% by weight of the p-phenylenediamine type color developing agent is accounted for by a N-hydroxyalkyl-substituted p-phenylenediamine type color developing agent, and the color developer solution further comprising a compound represented by the following formula (1) or (2):

formula (1)

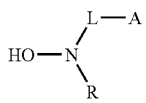

wherein R is a hydrogen atom or an alkyl group; L is an alkylene group; A is a carboxyl group, a sulfo group, a phosphono group, a phosphine group, a hydroxyl group, an amino group, an ammonio group, a carbamoyl group, a sulfamoyl group, an alkylsulfonyl group, an alkoxyl group or

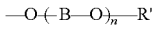

in which R' is a hydrogen atom or an alkyl group, B is an alkylene group and n is an integer of 1 to 4;

formula (2)

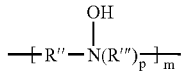

wherein R" and R'" are each independently a saturated or unsaturated aliphatic hydrocarbon group having from 1 to 6 carbon atoms, a cycloalkylene group or an arylene group; m is an integer of 4 to 50,000; and p is 0 or an integer of 1 to 10.

In another aspect the invention is directed to a processing method by the use of the foregoing color developer solution.

Thus, the present invention has come into being as a result of finding that the use of an N-hydroxyalkyl-substituted p-phenylenediamine type color developing agent in a specific amount of p-phenylenediamine type color developing agents, in combination with a compound having a specific structure surprisingly led to solution of the foregoing problems.

DETAILED DESCRIPTION OF THE INVENTION

Specific examples of p-phenylenediamine type color developing agents usable in this invention are shown below but are not limited to these:

(C-1) N,N-diethyl-p-phenylenediamine
(C-2) 4-amino-N,N-diethyl-3-metylaniline
(C-3) 4-amino-N-(β-hydroxyethyl)-N-methylaniline
(C-4) 4-amino-N-ethyl-N-(β-hydroxyethyl)aniline
(C-5) 4-amino-N-ethyl-N-(β-hydroxyethyl)-3-methylaniline
(C-6) 4-amino-N-ethyl-N-(3-hydroxypropyl)-3-methylaniline
(C-7) 4-amino-N-ethyl-N-(3-hydroxybutyl)-3-methylaniline
(C-8) 4-amino-N-ethyl-N-(β-methanesulfoneamidoethyl)-3-methylaniline
(C-9) 4-amino-N,N-diethyl-3-(β-hydroxyethyl) aniline
(C-10) 4-amino-N-ethyl-N-(β-methoxyethyl)-3-methylaniline
(C-11) 4-amino-N-ethyl-N-(β-ethoxyethyl)-3-methylaniline
(C-12) 4-amino-N-(3-carbamoylpropyl)-N-(n-propyl)-3-methylaniline
(C-13) 4-amino-N-(3-carbamoylbutyl)-N-(n-propyl)-3-methylaniline
(C-14) N-(4-amino-3-methylphenyl)-3-hydroxypyrrolidine
(C-15) N-(4-amino-3-methylphenyl)-3-(hydroxymethyl) pyrrolidine
(C-16) N-(4-amino-3-methylphenyl)-3-pyrrolidinecarboxamide.

Of the foregoing p-phenylene derivatives, compounds (C-6), (C-7), (C-8 and (C-12) are preferred and compound (C-8) is specifically preferred. These p-phenylenediamine derivatives may be in the form of a salt, such as a sulfate salt, hydrochloride salt, naphthalenedisulfonate salt and a p-toluenesulfonate salt.

N-hydroxyalkyl-substituted p-phenylenediamine type color developing agent usable in this invention can be represented by the following formula A:

formula A

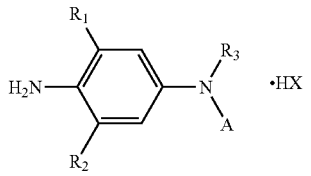

wherein $R_1$ is a hydrogen atom, an alkyl group having from 1 to 4 carbon atoms or an alkoxyl group having from 1 to 4 carbon atoms; $R_2$ is a hydrogen atom or an alkyl group having from 1 to 4 carbon atoms; $R_3$ is an alkyl group having from 1 to 4 carbon atoms, which may contains a hydroxyl group; and A is an alkyl group containing at least one hydroxyl group, which may be branched, and is preferably

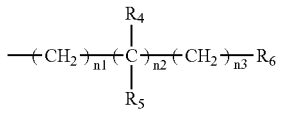

in which $R_4$, $R_5$ and $R_6$ are each a hydrogen atom, a hydroxyl group or an alkyl group having from 1 to 3 carbon atoms which may contain a hydroxyl group, provided that at least one of $R_4$, $R_5$ and $R_6$ is a hydroxyl group or an alkyl group containing a hydroxyl group, and n1, n2 and n3 are each 0, 1, 2 or 3; HX is hydrochloric acid, sulfuric acid, p-toluenesulfonic acid, nitric acid or phosphoric acid.

Such p-phenylenediamine type color developing agents are unstable in the form of a free amine and are generally used in the form of a salt (as specified in the foregoing formulas). Specific examples thereof include 4-amino-3-methyl-N-ethyl-N-(β-hydroxyethyl)-aniline salt and 4-amino-N-ethyl-N-(β-hydroxyethyl)-aniline salt. Specifically, 4-amino-3-methyl-N-ethyl-N-(β-hydroxyethyl)-aniline sulfate hydrate (which is commercially available as a name of CD-4) was proved to be effective in this invention.

Specific examples of N-hydroxyalkyl-substituted p-phenylenediamine derivatives are shown below but are not limited to these.

Exemplified Compound:

(A-1)

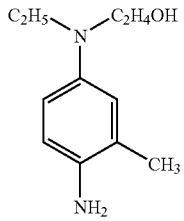

(A-2)

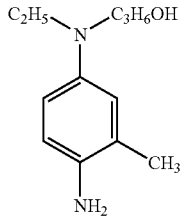

(A-3)

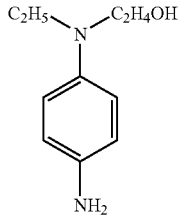

(A-4)

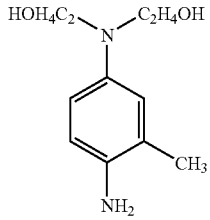

(A-5)

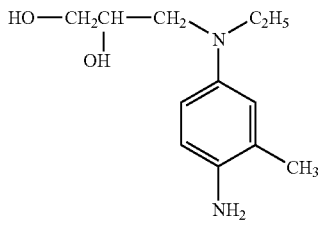

-continued (A-6)

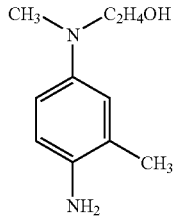

(A-7)

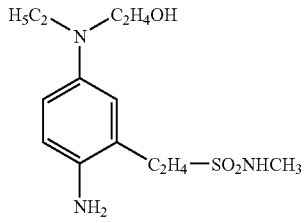

(A-8)

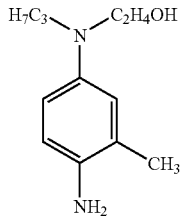

A hydrochloride salt, sulfate salt and a p-toluenesulfonate salt of the foregoing compounds (A-1) to (A-8) are specifically preferred. Of the foregoing compounds, compounds (A-1), (A-2), (A-6), (A-7) and (A-8) are preferred, compounds (A-1), (A-2) and (A-6) are more preferred, and compound (A-1) is still more preferred.

These N-hydroxyalkyl-substituted p-phenylenediamine derivatives can readily be synthesized according to the method described in Journal of American Chemical Society, 73, 3100 (1951).

When 2% to 35% (preferably 3% to 20%) by weight of the p-phenylenediamine type color developing agent contained in a developer solution is accounted for by a N-hydroxyalkyl-substituted p-phenylenediamine type color developing agent, advantageous effects of this invention are displayed.

The p-phenylenediamine type color developing agent is contained in a color developer solution preferably at from $1.4\times10^{-2}$ to $2.5\times10^{-2}$ mole/l, and more preferably $1.6\times10^{-2}$ to $2.0\times10^{-2}$ mole/l, whereby advantageous effects of this invention are displayed.

In one embodiment of this invention, the color developer solution contains a compound represented by the following formula (1):

formula (1)

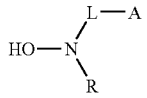

wherein L is an alkylene group; A is a carboxyl group, a sulfo group, a phosphono group, a phosphine group, a hydroxyl group, an amino group, an ammonio group, a carbamoyl group, a sulfamoyl group, an alkylsulfonyl group, an alkoxyl group or $$-O-(B-O)_n-R'$$

wherein R and R' are each a hydrogen atom or an alkyl group, B is an alkylene group and n integer of 1 to 4. The alkylene group represented by L, the alkyl group represented by R or R', and the alkylene group represented by B; each may be substituted by a substituent, for example, hydroxyl group. Further, the amino group, ammonio group, carbamoyl group and sulfamoyl group represented by A, each may be substituted and examples of a substituent include an alkyl group.

Specific examples of the compound of formula (1) are shown below.

(1-1)

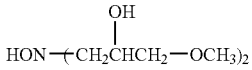

(1-2)

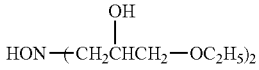

(1-3)

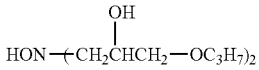

(1-4)

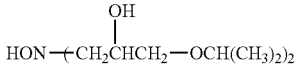

(1-5)

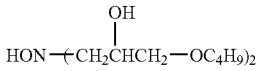

(1-6)

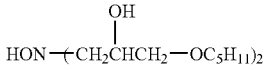

(1-7)

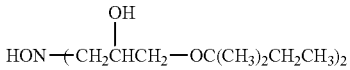

(1-8)

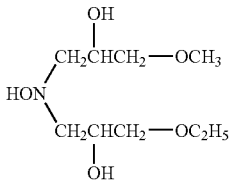

(1-9)

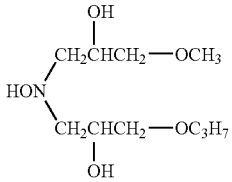

(1-10)

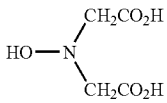

(1-11)

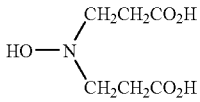

-continued
(1-12)
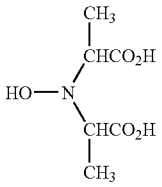
(1-13)
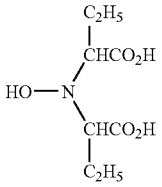
(1-14)
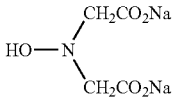
(1-15)
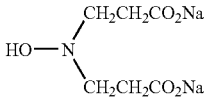
(1-16)
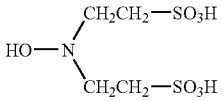
(1-17)
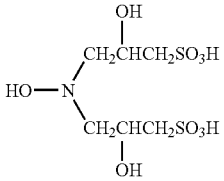
(1-18)
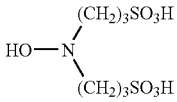
(1-19)
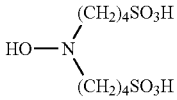
(1-20)
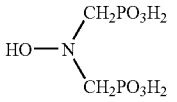
(1-21)
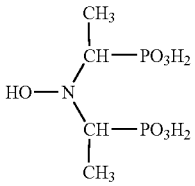
(1-22)
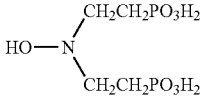
-continued
(1-23)
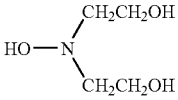
(1-24)
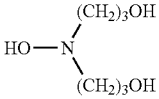
(1-25)
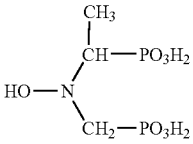
(1-26)
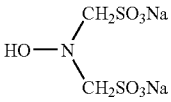
(1-27)
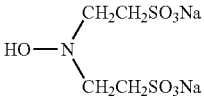
(1-28)
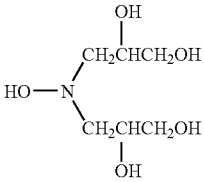
(1-29)
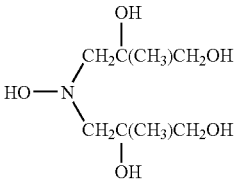
(1-30)
(1-31)
(1-32)
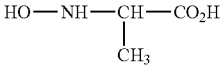
(1-33)
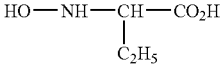
(1-34)
(1-35)
(1-36)
(1-37)
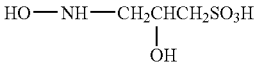
(1-38)
(1-39)
(1-40)
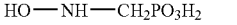

-continued (1-41)

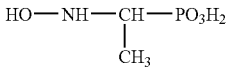

(1-42)

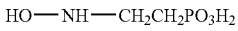

(1-43)

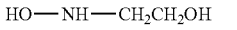

(1-44)

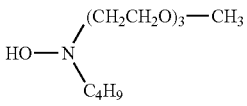

(1-45)

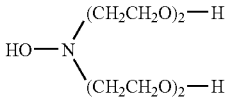

(1-46)

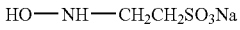

(1-47)

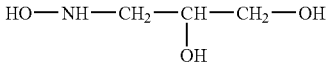

(1-48)

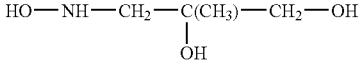

(1-49)

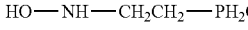

(1-50)

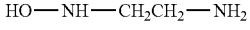

(1-51)

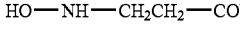

(1-52)

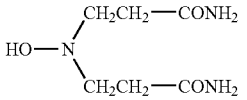

(1-53)

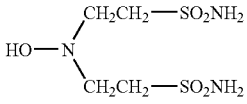

(1-54)

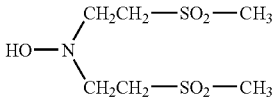

(1-55)

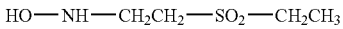

In another embodiment of this invention, the color developer solution contains a compound represented by the following formula (2):

formula (2)

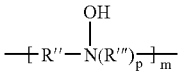

wherein R'' and R''' are each independently a saturated or unsaturated aliphatic hydrocarbon group having from 1 to 6 carbon atoms, a cycloalkylene group or an arylene group; m is an integer of 4 to 50,000; and p is 0 or an integer of 1 to 10.

The foregoing aliphatic hydrocarbon group may be saturated or unsaturated, in which the hydrocarbon chain may contain a divalent group such as an ether group, a carbonyl group or sulfonyl group. In other words, the hydrocarbon chain is optionally interrupted by a divalent group such as an ether group, a carbonyl group or sulfonyl group. The aliphatic hydrocarbon group may be substituted by a substituent such as hydroxyl or carboxyl group.

Specific examples of the compound represented by formula (2) are shown below.

(2-1)

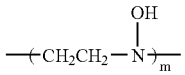

(2-2)

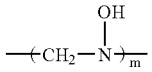

(2-3)

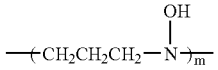

(2-4)

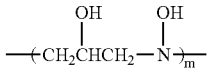

(2-5)

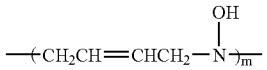

(2-6)

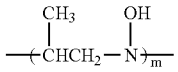

(2-7)

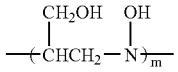

(2-8)

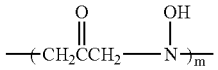

(2-9)

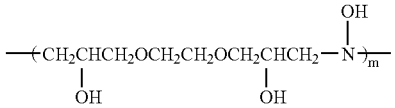

Of the compounds represented by formula (2), poly(N-hydroxyalkyleneimine) is preferred and poly(N-hydroxyethyleneimine) is specifically preferred. These polymeric compounds represented by formula (2) preferably have an average molecular weight of 500 to 65,000, and more preferably 600 to 30,000.

The compounds represented by formula (2) can be synthesized according to methods known in the art, for example, by oxidizing poly(alkyleneimine) through oxidation of a secondary amine using hydrogen peroxide, as described in J. Chem. Soc. 75, 1009 (1899), ibid 3144 (1963). Synthesis can also be done according to the method described in JP-A Nos. 2003-212993 and 2000-86606 (hereinafter, the term, JP-A refers to Japanese Patent Application Publication).

The compounds represented by formula (1) or (2) can be used alone or in combination and contained preferably at from 0.2 to 100 g, and more preferably from 0.5 to 50 g per liter of a color developer solution. The compounds represented by formula (1) may be used in the form of a sodium salt, potassium salt or lithium salt and preferably in the form of sodium salt in terms of handling.

The color developer solution preferably contains a compound represented by the following formula (3):

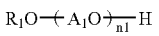

formula (3)

wherein $R_1$ is a hydrogen atom or a univalent saturated or unsaturated aliphatic hydrocarbon group having 1 to 4 carbon atoms (for example, an alkyl group and an alkenyl group); $A_1$ is a divalent saturated or unsaturated aliphatic alkylene group having 2 to 4 carbon atoms (for example, an alkylene group and alkenylene group); and n1 is an integer of from 1 to 200. The aliphatic hydrocarbon group represented by $R_1$ or $A_1$ may be substituted by a substituent and examples of such a substituent include a hydroxyl group. Specific examples of the compound represented by formula (3) are shown in Table 1.

TABLE 1

| Compound No. | $R_1$ | $A_1$ | n1 |
|---|---|---|---|
| 3-1 | H | —$CH_2CH_2$— | 1 |
| 3-2 | H | —$CH_2CH_2$— | 2 |
| 3-3 | H | —$CH_2CH_2$— | 3 |
| 3-4 | H | —$CH_2CH_2$— | 4 |
| 3-5 | H | —$CH_2CH_2$— | 5 |
| 3-6 | H | —$CH_2CH(OH)CH_2$— | 1 |
| 3-7 | H | —$CH_2CH(OH)CH_2$— | 2 |
| 3-8 | $CH_3$ | —$CH_2CH_2$— | 1 |
| 3-9 | $CH_3$ | —$CH_2CH_2$— | 2 |
| 3-10 | H | —$CH_2CH_2CH_2$— | 1 |
| 3-11 | H | —$CH_2CH_2CH_2$— | 2 |
| 3-12 | H | —$CH_2CH_2$— | 7 |
| 3-13 | H | —$CH_2CH_2$— | 18 |
| 3-14 | H | —$CH_2CH_2$— | 35 |
| 3-15 | H | —$CH_2CH_2$— | 68 |
| 3-16 | H | —$CH_2CH_2$— | 91 |
| 3-17 | H | —$CH_2CH_2$— | 136 |
| 3-18 | H | —$CH_2CH(OH)CH_2$— | 20 |
| 3-19 | H | —$CH(CH_3)CH_2$— | 2 |
| 3-20 | $C_2H_5$ | —$CH_2CH_2$— | 2 |

Furthermore, the color developer solution preferably contains a compound represented by the following formula (4), whereby further enhanced advantageous effects of this invention was achieved:

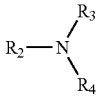

formula (4)

wherein $R_2$ is a hydroxyalkyl group having 2 to 6 carbon atoms; $R_3$ and $R_4$ are each a hydrogen atom, an alkyl group having 1 to 6 carbon atoms, a hydroxyalkyl group having 2 to 6 carbon atoms, a benzyl group, or

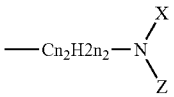

in which $n_2$ is an integer of 1 to 6, X and Y are each a hydrogen atom, an alkyl group having 1 to 6 carbon atoms or a hydroxyalkyl group having 2 to 6 carbon atoms.

Specific examples of the compound represented by the foregoing formula (4) are shown below:

(4-1) ethanolamine
(4-2) diethanolamine
(4-3) triethanolamine
(4-4) diisopropanolamine
(4-5) 2-methylaminoethanol
(4-6) 2-ethylaminoethanol
(4-7) 2-dimethylaminoethanol
(4-8) 2-diethylaminoethanol
(4-9) 1-diethylamino-2-propanol
(4-10) isopropanolamine
(4-11) 3-dimethylamino-2-propanol
(4-12) isopropylaminoethanol
(4-13) 3-amino-1-propanol
(4-14) 2-amino-2-methyl-1,3-propanediol
(4-15) ethyelenediamine tetraisopropanol
(4-16) benzyldiethanolamine
(4-17) 2-amino-2-(hydroxymethyl)-1,3-propanediol
(4-18) tris(isopropanol)amine.

The compounds represented by the foregoing formula (3) or (4), which can be used alone or in their combination, are contained in the color developer solution preferably at 2 to 100 g/l, and more preferably 5 to 50 g/l.

An N-hydroxyalkyl-substituted p-phenylenediamine type color developing agent is contained in an amount of 2% to 35% by weight (preferably 3 to 20% by weight) of the total amount of the p-phenylenediamine type color developing agents contained in the color developer solution.

The color developer solution can contain, as an alkali agent, carbonates such as potassium carbonate, sodium carbonate or lithium carbonate, sodium bicarbonate, potassium bicarbonate, trisodium phosphate, tripotassium phosphate, disodium phosphate, dipotassium phosphate, sodium borate, potassium borate, sodium tetraborate, potassium tetraborate, sodium o-hydroxybenzoate (or sodium salicylate), potassium o-hydroxysalicylate, sodium 5-sulfo-2-hydroxybenzoate (or sodium 5-sulfosalicylate), or potassium 5-sulfo-2-hydroxybenzoate (or potassium 5-sulfosalicylate).

The color developer solution can contain, as a preservative, sulfites (e.g., sodium sulfite, potassium sulfite), bisulfites (e.g., sodium bisulfite, potassium bisulfite), or metabisulfite (e.g., sodium metabisulfite, potassium metabisulfite). The color developer solution preferably contains a sulfite at not more than $1\times10^{-2}$ mol/l, and more preferably at more than 0 mol/l and not more than $0.5\times10^{-2}$ mol/l.

The color developer solution optionally contains a development accelerator, such as thioether compounds described in JP-B Nos. 37-16088, 37-5987, 38-7826, 44-12380, 45-9019, and U.S. Pat. No. 3,813,247; quaternary ammonium salts described in JP-B No. 44-30074, JP-A Nos. 50-137726, 56-156826, 52-43429; p-aminophenols described in U.S. Pat. Nos. 2,610,122 and 4,119,462; amine compounds described in U.S. Pat. Nos. 2,494,903, 3,128,182, 4,230,796, 3,253,919, JP-B No. 41-11431, and U.S. Pat. Nos. 2,482,546, 2,596,926 and 3,582,346; 1-phenyl-3-pyrazolidones, hydrazines, meso-ion type compounds, ion type compound and imidazoles.

The color developer solution may contain a compound capable of releasing a chloride ion, bromide ion, or iodide ion to prevent fogging.

The color developer solution may contain chelating agents, such as diethylenetriaminepentaacetic acid, hydroxyiminodiacetic acid, 1-hydroxyethylidene-1,1-diphosphonic acid, s,s-ethylenediaminesuccinic acid, and diethylenetriamine-pentaphosphonic acid. Specifically, incorporation of a chelating agent represented by general formula (K), as described on page 19–20 in JP-A No.4-118649 is preferred. Further, the color developer solution can contain anionic, cationic, amphoteric or nonionic surfactants.

Photographic materials relating to this invention include color film, color reversal film, color paper and color cinefilm and examples thereof are detailed in esearch Disclosure (hereinafter, also denoted simply as RD) described later.

Silver halide emulsion can be prepared according to methods described in RD No. 17643 page 22–23 (1979, December), 1. Emulsion preparation and type, and RD No. 18716, page 648; P. Glakides, Chimie et Physique Photographique, Paul Montel, 1967; G. F. Dauffin, Photographic Emulsion Chemistry, Focal Press, 1966; V. L. Zelikman et al., Making and Coating of Photographic Emulsion, Focal Press, 1964. Monodisperse emulsion is also preferred, as described in U.S. Pat. Nos. 3,574,628 and 3,665,394, and British Patent No. 1,413,748.

All of silver halide emulsions constituting photographic material preferably have a chloride content of not less than 90 mol % (preferably not less than 95 mol %), whereby advantageous effects of this invention are further enhanced.

Silver halide emulsion used in this invention can be subjected to physical ripening, chemical ripening and spectral sensitization. As additives used in these processes are shown compounds described in RD No. 17643, No. 18716 and No. 308119, as below.

| Item | RD 308119 | RD 17643 | RD 18716 |
|---|---|---|---|
| Chemical Sensitizer | 996, III-A | 23 | 648 |
| Spectral Sensitizer | 996, IV-A-A, B, C, D, H, I, J | 23–24 | 648–9 |
| Super Sensitizer | 996, IV-A-E, J | 23–24 | 648–9 |
| Antifoggant | 998, VI | 24–25 | 649 |
| Stabilizer | 998, VI | 24–25 | 649 |

Photographic additives usable in photographic material are also described, as below.

| Item | RD 308119 | RD 17643 | RD 18716 |
|---|---|---|---|
| Anti-staining agent | 1002, VII-I | 25 | 650 |
| Dye Image-Stabilizer | 1001, VII-J | 25 | |
| Britening Agent | 998, V | 24 | |
| U.V. Absorbent | 1003, VIII-I, XIII-C | 25–26 | |
| Light Absorbent | 1003, VIII | 25–26 | |
| Light-Scattering Agent | 1003, VIII | | |
| Filter Dye | 1003, VIII | 25–26 | |
| Binder | 1003, IX | 26 | 651 |
| Anti-Static Agent | 1006, XIII | 27 | 650 |
| Hardener | 1004, X | 26 | 651 |
| Plasticizer | 1006, XII | 27 | 650 |
| Lubricant | 1006, XII | 27 | 650 |
| Surfactant, Coating aid | 1005, XI | 26–27 | 650 |
| Matting Agent | 1007, XVI | | |
| Developing Agent (incorporated in photographic material) | 1001, XXB | | |

A variety of couplers can be employed in the invention and examples thereof are described in research Disclosures described above. Relevant description portions are shown below.

| Item | RD 308119 | RD 17643 |
|---|---|---|
| Yellow coupler | 1001, VII-D | VII-C - G |
| Magenta coupler | 1001, VII-D | VII-C - G |
| Cyan coupler | 1001, VII-D | VII-C - G |
| Colored coupler | 1002, VII-G | VII-G |
| DIR coupler | 1001, VII-F | VII-F |
| BAR coupler | 1002, VII-F | |
| PUG releasing coupler | 1001, VII-F | |
| Alkali-soluble coupler | 1001, VII-E | |

Additives used in the invention can be added by dispersion techniques described in RD 308119 XIV. In the invention are employed supports described in RD 17643, page 28; RD 18716, page 647–648; and RD 308119 XIX. In the photographic material relating to the invention, there can be provided auxiliary layers such as a filter layer and an interlayer, as described in RD 308119 VII-K, and arranged in a variety of layer orders such as normal layer order, reverse layer order and a unit layer arrangement.

An exposed photographic material is developed using the color developer solution of this invention under preferred time and temperature conditions in a preferable processing apparatus to form desired silver image and color image. Thereafter, the photographic material is further subjected to processing steps known in the art, including, for example, a development stopping step, bleaching step, fixing step, bleach-fixing step, washing (or rinsing) step, stabilization step and drying step. The processing time and temperature in the respective processing steps are those which are applicable in the art, for example, color development is performed at a temperature of 20 to 60° C. for a period of 10 to 250 sec.

EXAMPLES

Constitution and effects of the present invention will be further described based on specific examples but embodiments of the invention are by no means limited to these.

Example 1

Color paper used in Example 1 was prepared as follows. There was prepared a paper support laminated, on the emulsion layer side of paper with a weight of 160 g/m$^2$, with high density polyethylene, provided that the emulsion layer side was laminated with polyethylene melt containing surface-treated anatase type titanium oxide in an amount of 15% by weight. This reflection support was subjected to corona discharge and provided with a gelatin sublayer, and further thereon, the component layers, as shown below were coated by free-falling vertical curtain coating method, as described in JP-A No. 49-35447, at a coating speed of 350 m/min to prepare a multilayer color photographic material Sample 101.

1st Layer Coating Solution:

Into 60 ml of ethyl acetate were added and dissolved 24.3 g of yellow coupler (Y-1), 3.34 g of dye image stabilizer (ST-1), 3.34 g of dye image stabilizer (ST-2), 3.34 g of dye image stabilizer (ST-5), 0.34 g of antistaining agent (HQ-1), 5.2 g of image stabilizer A, 5.0 g of high boiling organic solvent (DBP) and 1.67 g of high boiling solvent (DNP). Using an ultrasonic homogenizer, the resulting solution was dispersed in 300 ml of an aqueous 7% gelatin solution containing 5 ml of an aqueous 10% surfactant (SU-1)

solution to obtain a yellow coupler emulsified dispersion. The obtained dispersion was mixed with the blue-sensitive silver halide emulsion (Em-B) prepared under conditions described below and a sulfosuccinic acid type surfactant (SU-2) was added thereto at 0.5 g/l to prepare a 1st layer coating solution.

7th Layer Coating Solution:

To 6 ml of ethyl acetate was added 1.9 g of a high boiling solvent (DBP) and 1.9 g of a high boiling solvent (DIDP) and dispersed in 38 ml of an aqueous 7% gelatin solution containing 2 ml of an aqueous 10% surfactant (SU-1) solution to prepare 70 ml of an emulsified dispersion of a high boiling organic solvent. The thus emulsified dispersion was mixed with an aqueous 11% gelatin solution and a dispersion of silicon dioxide having an average particle size of 2 μm was added thereto and a sulfosuccinic acid type surfactant (SU-2) was further added at 2.1 g per liter of coating solution to prepare a coating solution of the 7th layer.

Coating solutions for other layers were each prepared similarly to the foregoing 1st and 7th layer coating solutions, and the respective coating solutions were coated so as to have a coating amount as shown below.

A coating amount of a silver halide emulsion, as described below is represented by equivalent converted to silver. To the respective layers was added F-1.

| Layer | Constitution | Amount (g/m$^2$) |
|---|---|---|
| 7th Layer | Gelatin | 0.690 |
| (Protective layer) | DBP | 0.002 |
| Wet thickness: 7.0 μm | DIDP | 0.002 |
| | Silicon dioxide | 0.003 |
| | Surfactant (SU-1) | 0.002 |
| | Surfactant (SU-2) | 0.021 |
| | Hardener (M-2) | 0.060 |
| 6th Layer | Gelatin | 0.380 |
| (UV absorbing layer) | AI-1 | 0.010 |
| Wet thickness: 5.0 μm | UV absorbent (UV-1) | 0.120 |
| | UV absorbent (UV-2) | 0.040 |
| | UV absorbent (UV-3) | 0.170 |
| | Antistaining agent (HQ-5) | 0.040 |
| | PVP | 0.030 |
| | Surfactant (SU-1) | 0.071 |
| 5th Layer | Gelatin | 1.000 |
| (Red-sensitive layer) | Red-sensitive emulsion (Em-R) | 0.210 |
| Wet thickness: 13.0 μm | Cyan coupler (C-1) | 0.260 |
| | Cyan coupler (C-2) | 0.075 |
| | Dye image stabilizer (ST-1) | 0.010 |
| | Antistaining agent (HQ-5) | 0.004 |
| | DBP | 0.100 |
| | DOP | 0.190 |
| | Surfactant (SU-1) | 0.025 |
| 4th Layer | Gelatin | 0.880 |
| (UV absorbing layer) | AI-1 | 0.020 |
| Wet thickness: 10.0 μm | UV absorbent (UV-1) | 0.280 |
| | UV absorbent (UV-2) | 0.090 |
| | UV absorbent (UV-3) | 0.380 |
| | Antistaining agent (HQ-5) | 0.100 |
| | Surfactant (SU-1) | 0.020 |
| | Hardener (M-1) | 0.036 |
| 3rd Layer | Gelatin | 1.000 |
| (Green-sensitive layer) | Green-sensitive Emulsion (Em-G) | 0.140 |
| Wet thickness: 14.0 μm | AI-2 | 0.010 |
| | Magenta coupler (M-1) | 0.210 |
| | Dye image stabilizer (ST-3) | 0.200 |
| | Dye image stabilizer (ST-4) | 0.170 |
| | DBP | 0.130 |
| | DIDP | 0.130 |
| | Surfactant (SU-1) | 0.022 |
| 2nd layer | Gelatin | 0.980 |
| (Interlayer) | AI-3 | 0.010 |
| Wet thickness: 12.0 μm | Antistaining agent (HQ-2) | 0.030 |
| | Antistaining agent (HQ-3) | 0.030 |
| | Antistaining agent (HQ-4) | 0.050 |
| | Antistaining agent (HQ-5) | 0.023 |
| | DBP | 0.020 |
| | DIDP | 0.030 |
| | Surfactant (SU-1) | 0.007 |
| | Hardener (M-1) | 0.035 |

-continued

| | | |
|---|---|---|
| 1st layer | Gelatin | 1.000 |
| (Blue-sensitive layer) | Blue-sensitive Emulsion (Em-B) | 0.250 |
| Wet thickness: 14.0 μm | Yellow coupler (Y-1) | 0.720 |
| | Dye image stabilizer (ST-1) | 0.100 |
| | Dye image stabilizer (ST-2) | 0.100 |
| | Dye image stabilizer (ST-5) | 0.100 |
| | Antistaining agent (HQ-1) | 0.010 |
| | Image stabilizer A | 0.160 |
| | DBP | 0.150 |
| | DNP | 0.050 |
| | Surfactant (SU-1) | 0.015 |
| | Surfactant (SU-2) | 0.015 |
| Support | Polyethylene-laminated paper containing a small amount of colorant | |

SU-1: sodium tri-i-ptopylnaphthalenesulfonate
SU-2: di-octylsulfosuccinate sodium salt
DBP: dibutyl phthalate
DNP: dinonyl phthalate
DOP: dioctyl phthalate
DIDP: diisodecyl phthalate
PVP: polyvinylpyrrolidone
H-1: tetrakis(vinylsulfonylmethyl)methane
H-2: 2,4-dichloro-6-hydroxy-s-triazine sodium salt
HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecylhydoquinone
HQ-5: 2,5-di(1,1-dimethyl-4-hexyloxycarbonyl)-butylhydroqinone
Image stabilizer A: p-t-octylphenol

Y-1

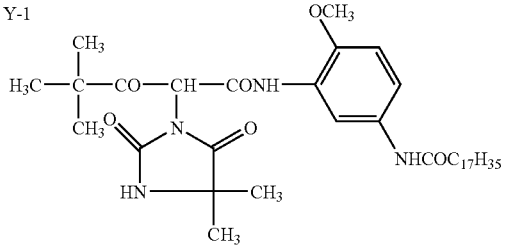

M-1

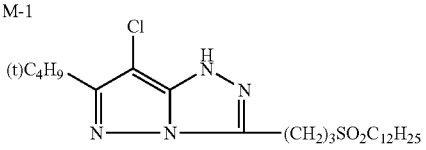

C-1

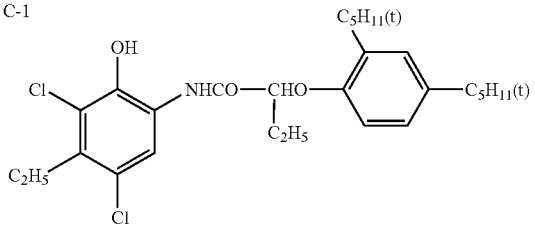

C-2

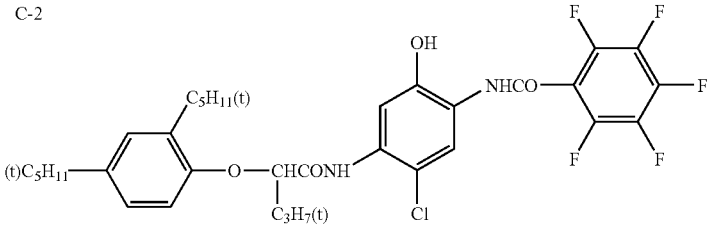

-continued
ST-1
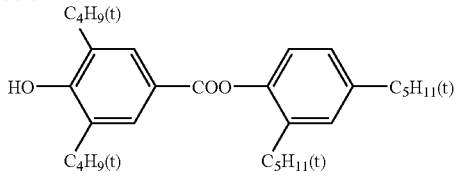
ST-2
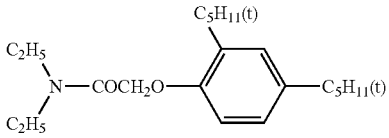
ST-3
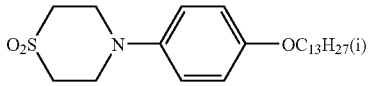
ST-4
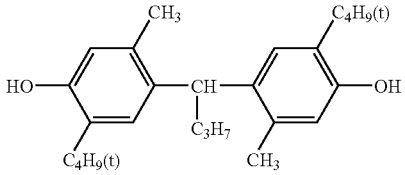
ST-5
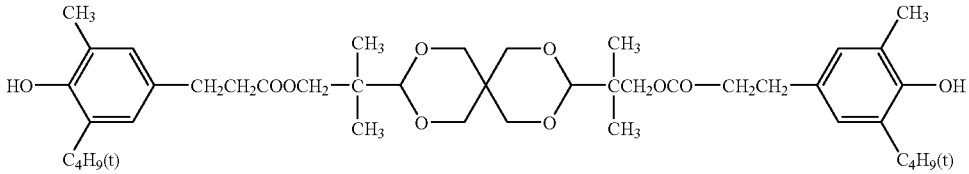
UV-1
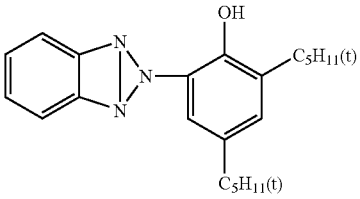
UV-2
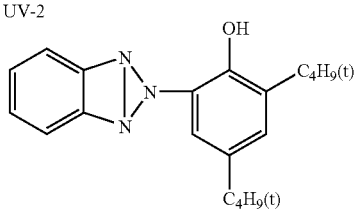
UV-3
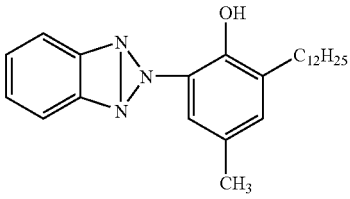

-continued
AI-1
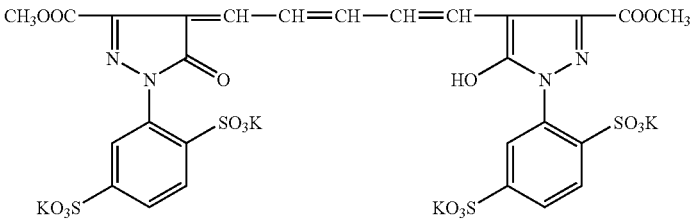
AI-2
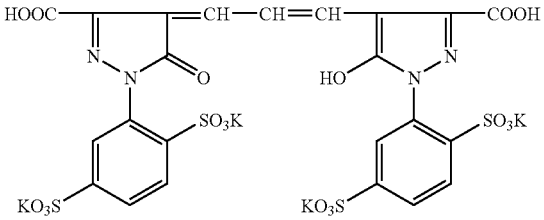
AI-3
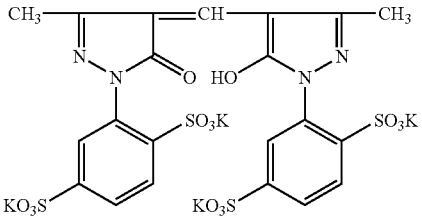
F-1
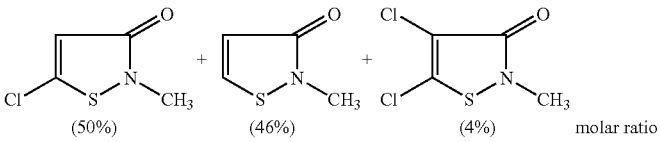
BS-1
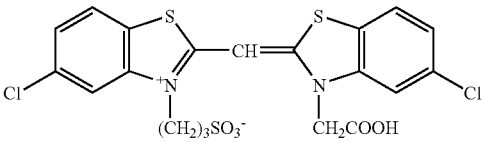
BS-2
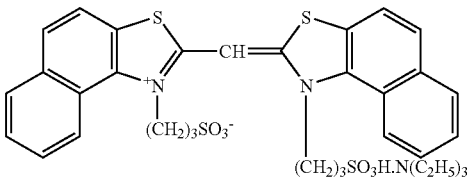
GS-1
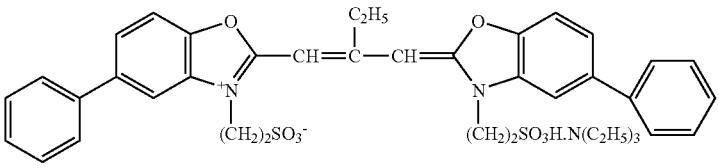

-continued

RS-1

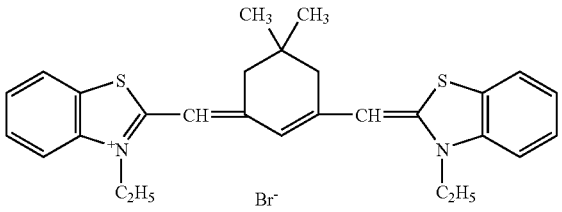

RS-2

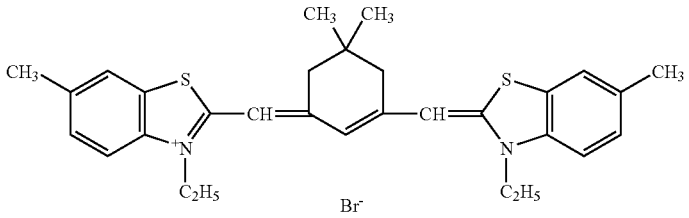

SS-1

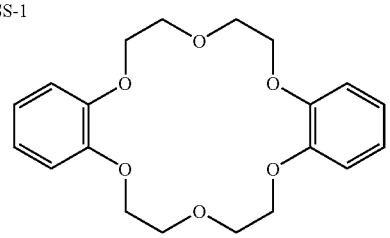

Preparation of Blue-Sensitive Silver Halide Emulsion

To 1 liter of aqueous 2% gelatin solution kept at 40° C. were simultaneously added the following solutions A and B for a period of 30 min., while being maintained at a pAg of 7.3 and pH of 3.0, and further thereto were added Solutions C and D for a period of 180 min., while being maintained at a pAg of 8.0 and pH of 5.5. The pAg was controlled by the method described in JP-A 59-45437, and the pH was adjusted using aqueous sulfuric acid or sodium hydroxide solution.

| | |
|---|---|
| Solution A | |
| Sodium chloride | 3.50 g |
| Potassium bromide | 0.03 g |
| Water to make | 200 ml |
| Solution B | |
| Silver nitrate | 10 g |
| Water to make | 200 ml |
| Solution C | |
| Sodium chloride | 105.0 g |
| $K_2IrCl_6$ | $4 \times 10^{-5}$ mol/mol AgX |
| $K_4Fe(CN)_6$ | $2 \times 10^{-5}$ mol/mol Agx |
| Potassium bromide | 1.0 g |
| Water to make | 600 ml |
| Solution D | |
| Silver nitrate | 300 g |
| Water to make | 600 ml |

After completing the addition, the resulting emulsion was desalted using a 5% aqueous solution of Demol N (produced by Kao-Atlas) and aqueous 20% magnesium sulfate solution, and redispersed in a gelatin aqueous solution to obtain a monodisperse cubic grain emulsion (EMP-1) having an average grain size of 0.71 μm, a coefficient of variation of grain size of 0.07 and a chloride content of 99.5 mol %.

A mono-disperse cubic grain emulsion (EMP-1B) having an average grain size of 0.64 μm, a coefficient of variation of grain size of 0.07 and a chloride content of 99.5 mol %. was prepared similarly to the foregoing emulsion (EMP-1), provided that the addition time of Solutions A and B, and the addition time of Solutions C and D were respectively varied.

The thus obtained emulsion, EMP-1 was chemically sensitized at 60° C. using the following compounds. Similarly, emulsion EMP-1B was chemically sensitized. The thus chemically sensitized emulsions EMP-1 and EMP-1B were mixed in a ratio of 1:1 to obtain blue-sensitive silver halide emulsion (Em-B).

| | |
|---|---|
| Sodium thiosulfate | 0.8 mg/mol AgX |
| Chloroauric acid | 0.5 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

STAB-1: 1-(3-Acetoamidophenyl)-5-mercaptotetrazole
STAB-2: 1-Phenyl-5-mercaptotetrazole
STAB-3: 1-(4-Ethoxyphenyl)-5-mercaptotetrazole Preparation of Green-Sensitive Silver Halide Emulsion Monodisperse cubic grain emulsions, EMP-2 having an average grain size of 0.40 μm, a coefficient of variation of grain size of 0.08 and a chloride content of 99.5 mol %, and EMP-2B having an average grain size of 0.50 μm, a coefficient of variation of grain size of 0.08 and a chloride content of 99.5 mol % were prepared in the same manner as in preparation of EMP-1 and EMP-1B, respectively, provided that the addition time of Solutions A and B, and the addition time of Solutions C and D were respectively varied.

The thus obtained emulsion, EMP-2 was chemically sensitized at 55° C. using the following compounds. Similarly, emulsion EMP-2B was chemically sensitized. The thus chemically sensitized emulsions EMP-2 and EMP-2B were mixed in a ratio of 1:1 to obtain blue-sensitive silver halide emulsion (Em-G).

| | |
|---|---|
| Sodium thiosulfate | 1.5 mg/mol AgX |
| Chloroauric acid | 1.0 mg/mol AgX |
| Stabilizer STAB-1 | $3 \times 10^{-4}$ mol/mol AgX |
| Stabilizer STAB-2 | $2 \times 10^{-4}$ mol/mol AgX |
| Stabilizer STAB-3 | $3 \times 10^{-4}$ mol/mol AgX |
| Sensitizing dye GS-1 | $4 \times 10^{-4}$ mol/mol AgX |

Preparation of Red-Sensitive Silver Halide Emulsion

Monodisperse cubic grain emulsions, EMP-3 having an average grain size of 0.40 μm, a coefficient of variation of grain size of 0.08 and a chloride content of 99.5 mol %, and EMP-3B having an average grain size of 0.38 μm, a coefficient of variation of grain size of 0.08 and a chloride content of 99.5 mol % were prepared in the same manner as in preparation of EMP-1 and EMP-1B, respectively, provided that the addition time of Solutions A and B, and the addition time of Solutions C and D were respectively varied.

The thus obtained emulsion, EMP-3 was chemically sensitized at 60° C. using the following compounds. Similarly, emulsion EMP-3B was chemically sensitized. The thus chemically sensitized emulsions EMP-3 and EMP-3B were mixed in a ratio of 1:1 to obtain blue-sensitive silver halide emulsion (Em-R).

| | |
|---|---|
| Sodium thiosulfate | 1.8 mg/mol AgX |
| Chloroauric acid | 2.0 mg/mol AgX |
| Stabilizer STAB-1 | $3 \times 10^{-4}$ mol/mol AgX |
| Stabilizer STAB-2 | $2 \times 10^{-4}$ mol/mol AgX |
| Stabilizer STAB-3 | $3 \times 10^{-4}$ mol/mol AgX |
| Sensitizing dye RS-1 | $1 \times 10^{-4}$ mol/mol AgX |
| Sensitizing dye RS-2 | $1 \times 10^{-4}$ mol/mol AgX |
| Stabilizer SS-1 | $2.0 \times 10^{-5}$ mol/mol AgX |

Process

Processing was conducted according to the following steps under the conditions described below, using an automatic processor.

| Processsing Step | Temperature | Time | Repl.*1 | Tank*2 |
|---|---|---|---|---|
| Color developing | 45.0° C. | 20 sec. | 60 ml/m$^2$ | 15 l |
| Bleach-fixing | 38.0° C. | 20 sec. | 54 ml/m$^2$ | 15 l |
| Stabilizing-1 | 38.0° C. | 10 sec. | | 8 l |
| Stabilizing-2 | 38.0° C. | 10 sec. | | 8 l |
| Stabilizing-3 | 38.0° C. | 10 sec. | | 8 l |
| Stabilizing-4 | 38.0° C. | 10 sec. | 120 ml/m$^2$ | 8 l |
| Drying | 60–80° C. | 15 sec. | | |

*1Replenishing rate (ml/m$^2$)
*2Tank solution volume (liter)

The cross-over time of the respective steps was 4 sec. and the stabilizing steps were a countercurrent system in the direction of from (stabilizing-4) to (stabilizing-1).

Composition of processing solution is shown below.

Color Developer Solution (Per Liter)

| | Tank solution. | Replenisher |
|---|---|---|
| Potassium carbonate | 25 g | 30 g |
| p-Toluenesulfonic acid | 10 g | 10 g |
| Potassium chloride | 4 g | 5 g |
| Sodium hydroxide | 6 g | 9 g |
| Color developing agent (Table 2) | 7.8 g | 9.5 g |
| Additive compound (Table 2) | 7 g | 9 g |
| Potassium sulfite | 0.3 g | 0.3 g |
| Diethylene glycol | 20 g | 20 g |
| Chinopal SFP (Ciba Geigy) | 2 g | 2 g |
| Sodoim diethylenetriaminepentaacetate | 4 g | 5 g |
| pH | 10.2 | 12.3 |

Water is added to make 1 liter, and the pH was respectively adjusted with potassium hydroxide or 50% sulfuric acid.

The foregoing color developing agent was added in an amount described above and color developing agents were varied as shown in Table 2. In the Table 2, CD-4/CD-3 means the use of a mixture of color developing agents CD-4 and CD-3 and the values in parentheses represents the weight percentage of N-hydroxyalkyl-substituted color developing agent (e.g., CD-4) based on the total amount of p-phenylenediamine type color developing agents. The foregoing additive compound means that the compounds represented by formula (1) or (2) was used as shown in Table 2.

Bleach-Fixer (Per Liter)

| | Tank solution | Replenisher |
|---|---|---|
| Ammonium thiosulfate | 55 g | 70 g |
| Ammonium sulfite | 8 g | 10 g |
| Ammonium metabisulfite | 4 g | 6 g |
| Ammonium Fe (III) ethylenediaminetetraacetate | 45 g | 56 g |
| Ethylenediaminetetraacetic acid | 1 g | 1.2 g |
| pH | 6.0 | 5.4 |

Water is added to make 1 liter, and the pH is adjusted with ammonia water or acetic acid.

| Stabilizer (per liter of tank solution and replenisher) | |
|---|---|
| Benzisothiazoline-3-one | 0.1 g |
| Ethylenediaminetetraacetatic acid | 1.0 g |
| 1-Hydroxyethylidene-1,1-diphosphonic acid | 2.0 g |
| Chinopal SFP (Ciba-Geigy) | 0.3 g |
| o-Phenylphenol | 0.1 g |
| pH | 7.5 |

Water is added to make 1 liter, and the pH is adjusted with ammonia water or sulfuric acid.

Using the thus prepared color paper and processing solutions, processing was continuously run in an automatic processor under the processing conditions described above over a period of 2 months at a room temperature of 15° C. so that the developer solution was replaced at 0.05 R per day (in which the term 0.05 R represents a replacement amount and means that color paper was processed in an amount corresponding to the replenished developer amount being 0.05 based on 1 of the tank solution volume).

After completion of continuous processing, the state of crystalline precipitation in the developer replenishing tank was visually observed, the yellow reflection density (in the maximum density area, denoted as Y-$D_{max}$) of processed color paper was measured using a reflection densitometer, and staining in edge portions of color paper was visually evaluated.

Precipitation was evaluated based on the following criteria:

A: no precipitation was observed,

B: slight precipitation was observed but acceptable to practical use,

C: marked precipitation was observed.

Edge staining was also evaluated based on the following criteria:

A: no staining was observed,

B: slight staining was observed but acceptable to practical use,

C: marked staining was observed.

Evaluation results are shown in Table 2.

TABLE 2

| Experiment No. | Color Developing Agent (*) | Additive Compound | Precipitation | Y-$D_{max}$ | Edge Stain | Remark |
|---|---|---|---|---|---|---|
| 1 | CD-4/CD-3 (0) | (1-27) | C | 1.81 | A | Comp. |
| 2 | CD-4/CD-3 (1) | (1-27) | C | 1.97 | A | Comp. |
| 3 | CD-4/CD-3 (2) | (1-27) | B | 2.14 | A | Inv. |
| 4 | CD-4/CD-3 (3) | (1-27) | A | 2.20 | A | Inv. |
| 5 | CD-4/CD-3 (4) | (1-27) | A | 2.23 | A | Inv. |
| 6 | CD-4/CD-3 (5) | (1-27) | A | 2.26 | A | Inv. |
| 7 | CD-4/CD-3 (10) | (1-27) | A | 2.31 | A | Inv. |
| 8 | CD-4/CD-3 (15) | (1-27) | A | 2.33 | A | Inv. |
| 9 | CD-4/CD-3 (20) | (1-27) | A | 2.33 | A | Inv. |
| 10 | CD-4/CD-3 (28) | (1-27) | A | 2.34 | B | Inv. |
| 11 | CD-4/CD-3 (35) | (1-27) | A | 2.36 | B | Inv. |
| 12 | CD-4/CD-3 (40) | (1-27) | A | 2.39 | C | Comp. |
| 13 | CD-4/CD-3 (50) | (1-27) | A | 2.41 | C | Comp. |
| 14 | CD-4/CD-3 (10) | (1-15) | A | 2.22 | A | Inv. |
| 15 | CD-4/CD-3 (10) | (1-1) | A | 2.23 | A | Inv. |
| 16 | CD-4/CD-3 (10) | (1-29) | A | 2.20 | A | Inv. |
| 17 | CD-4/CD-3 (10) | (1-45) | A | 2.23 | A | Inv. |
| 18 | CD-4/CD-3 (10) | (2-1) | A | 2.25 | A | Inv. |
| 19 | CD-4/CD-3 (10) | (2-9) | A | 2.22 | A | Inv. |
| 20 | CD-4/CD-3 (10) | HAS | B | 1.16 | A | Comp. |
| 21 | CD-4/CD-3 (10) | DEHA | B | 2.01 | C | Comp. |
| 22 | (C-2) (0) | (1-27) | C | 2.03 | C | Comp. |
| 23 | (C-12) (0) | (1-27) | B | 2.04 | C | Comp. |

(*) weight percentage of N-hydroxyalkyl-substituted p-phenylenediamine type color developing agent In the foregoing Table 2, CD-3 is a sulfate salt of the foregoing exemplified compound (C-8) and CD-4 is a sulfate salt of the foregoing exemplified compound (A-1). Compounds (C-2) and (C-12) were used in the form of a sulfate salt. Of the additive compounds, "HAS" and "DEHA" represent hydroxylamine sulfate and diethylhydroxylamine, respectively.

As apparent from Table 2, it was proved that when 2% to 35% by weight of p-phenylenediamine type color developing agents contained in the color developer solution was a N-hydroxyalkyl-substituted p-phenylenediamine type color developing agent and the compound represented by formula (1) or (2) was further contained, advantageous effects of this invention was achieved. It was proved that when the N-hydroxyalkl-substituted p-phenylenediamine type color developing agent was contained at 3% to 20% by weight, further enhanced effects of this invention were achieved.

Example 2

Processing was conducted similarly to Experiment No. 4 in Example 1, provided that the sulfite contents of a color developer solution and its replenisher solution were varied as shown in Table 3. Evaluation results are shown in Table 3.

TABLE 3

| Experiment No. | Sulfite (mol/l) | Y-$D_{max}$ | Edge Stain |
|---|---|---|---|
| 24 | $2 \times 10^{-2}$ | 2.12 | B |
| 25 | $1 \times 10^{-2}$ | 2.14 | A |
| 26 | $0.5 \times 10^{-2}$ | 2.20 | A |
| 27 | $0.2 \times 10^{-2}$ | 2.22 | A |
| 28 | $0.1 \times 10^{-2}$ | 2.24 | A |
| 29 | 0 | 2.25 | A |

As can be seen from Table 3, it was proved that a sulfite content of not more than $1\times10^{-2}$ mol/l resulted in enhanced effects of this invention and a sulfite content of more than 0 mol/l and not more than $0.5\times10^{-2}$ mol/l resulted in further enhanced effects of this invention.

Example 3

Processing was conducted similarly to Experiment No. 4 in Example 1, provided that the color developing agent content of a color developer solution was varied as shown in Table 4. Evaluation results are shown in Table 4.

TABLE 4

| Experiment No. | Color Developing Agent (mol/l) | Y-$D_{max}$ | Edge Stain | Precipitation |
|---|---|---|---|---|
| 30 | $1.2 \times 10^{-2}$ | 2.10 | B | A |
| 31 | $1.4 \times 10^{-2}$ | 2.14 | A | A |

TABLE 4-continued

| Experiment No. | Color Developing Agent (mol/l) | Y-$D_{max}$ | Edge Stain | Precipitation |
|---|---|---|---|---|
| 32 | $1.6 \times 10^{-2}$ | 2.18 | A | A |
| 33 | $1.8 \times 10^{-2}$ | 2.20 | A | A |
| 34 | $2.0 \times 10^{-2}$ | 2.22 | A | A |
| 35 | $2.5 \times 10^{-2}$ | 2.23 | B | A |
| 36 | $2.8 \times 10^{-2}$ | 2.24 | B | B |

As can be seen from Table 4, it was proved that a color developing agent content of from $1.4\times10^{-2}$ to $2.5\times10^{-2}$ mol/l resulted in enhanced effects of this invention and a color development agent content of from $1.6\times10^{-2}$ to $2.0\times10^{-2}$ mol/l resulted in specifically superior effects of this invention.

Example 4

Processing was conducted similarly to Experiment No. 4 in Example 1, provided that diethylene glycol contained in the color developer solution was replaced by compounds shown in Table 5. Evaluation on results are shown in Table 5.

TABLE 5

| Experiment No. | Organic Solvent | Y-$D_{max}$ | Edge stain |
|---|---|---|---|
| 37 | 3-2 | 2.20 | A |
| 38 | 3-1 | 2.17 | A |
| 39 | 3-13 | 2.19 | A |
| 40 | 3-18 | 2.18 | A |
| 41 | 4-3 | 2.20 | A |
| 42 | 4-18 | 2.23 | A |
| 43 | — | 2.21 | B |

As can be seen from Table 5, it was proved that the use of compounds represented by formula (3) or (4) led further superior results of this invention.

Example 5

Color paper samples were prepared similarly to a color paper used in Experiment No. 7, provided that the chloride contents of the emulsion were varied as shown in Table 6. Using the thus prepared color paper samples, processing was conducted similarly to Experiment No. 4 in Example 1. Evaluation results are shown in Table 6.

TABLE 6

| Experiment No. | Chloride Content (mol %) | Y-$D_{max}$ | Edge Stain |
|---|---|---|---|
| 44 | 85 | 2.03 | A |
| 45 | 90 | 2.13 | A |
| 46 | 95 | 2.21 | A |
| 47 | 98 | 2.25 | A |
| 48 | 99 | 2.28 | A |
| 49 | 99.5 | 2.31 | A |

As can be seen from table 6, it was proved that a 90 mol % or more chloride content of silver halide used in color paper resulted in enhanced superior effects of this invention and a 95 mol % or more chloride content resulted in further enhanced effects.

What is claimed is:

1. A color developer solution comprising p-phenylenediamine color developing agents, wherein 2% to 35% by weight of the p-phenylenediamine color developing agents is accounted for by a N-hydroxyalkyl-substituted p-phenylenediamine color developing agent, and the color developer solution further comprising a compound represented by the following formula (1) or (2):

formula (1)

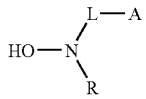

wherein R is a hydrogen atom or an alkyl group; L is an alkylene group; A is a carboxyl group, a sulfo group, a phosphono group, a phosphine group, a hydroxyl group, an amino group, an ammonio group, a carbamoyl group, a sulfamoyl group, an alkylsulfonyl group, an alkoxyl group or $$-O-(B-O)_n-R'$$

in which R' is a hydrogen atom or an alkyl group, B is an alkylene group and n is an integer of 1 to 4;

formula (2)

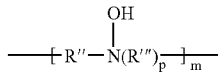

wherein R" and R"' are each independently a saturated or unsaturated aliphatic hydrocarbon group having from 1 to 6 carbon atoms, a cycloalkylene group or an arylene group; m is an integer of 4 to 50,000; and p is 0 or an integer of 1 to 10 wherein the color developer solution comprises the p-phenylenediamine color developing agents in an amount of from 1.4×10–2 to 2.5×10–2 mol/l.

2. The color developer solution of claim 1, wherein the color developer solution comprises a sulfite of not more than $1\times10^{-2}$ mol/l.

3. The color developer solution of claim 1, wherein the color developer solution comprises a compound represented by the following formula (3):

$$R_1O-(A_1O)_{n1}-H \qquad \text{formula (3)}$$

wherein $R_1$ is a hydrogen atom or a saturated or unsaturated aliphatic hydrocarbon group having 1 to 4 carbon atoms; $A_1$ is a saturated or unsaturated aliphatic hydrocarbon group having 2 to 4 carbon atoms; and n1 is an integer of from 1 to 200.

4. The color developer solution of claim 1, wherein the color developer solution comprises a compound represented by the following formula (4):

formula (4)

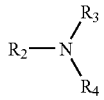

wherein $R_2$ is a hydroxyalkyl group having 2 to 6 carbon atoms; $R_3$ and $R_4$ are each a hydrogen atom, an alkyl group having 1 to 6 carbon atoms, a hydroxyalkyl group having 2 to 6 carbon atoms, a benzyl group, or

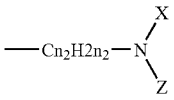

in which $n_2$ is an integer of 1 to 6, X and Y are each a hydrogen atom, an alkyl group having 1 to 6 carbon atoms or a hydroxyalkyl group having 2 to 6 carbon atoms.

5. A processing method of a silver halide color photographic material comprising:

exposing the photographic material and developing the exposed photographic material with a color developer solution, wherein the color developer solution comprises p-phenylenediamine color developing agents and 2% to 35% by weight of the p-phenylenediamine color developing agents is accounted for by a N-hydroxyalkyl-substituted p-phenylenediamine color developing agent, and the color developer solution further comprising a compound represented by the following formula (1) or (2):

formula (1)

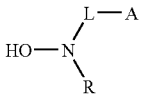

wherein R is a hydrogen atom or an alkyl group; L is an alkylene group; A is a carboxyl group, a sulfo group, a phosphono group, a phosphine group, a hydroxyl group, an amino group, an ammonio group, a carbamoyl group, a sulfamoyl group, an alkylsulfonyl group, an alkoxyl group or

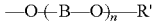

in which R' is a hydrogen atom or an alkyl group, B is an alkylene group and n is an integer of 1 to 4;

formula (2)

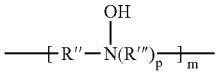

wherein R" and R"' are each independently a saturated or unsaturated aliphatic hydrocarbon group having from 1 to 6 carbon atoms, a cycloalkylene group or an arylene group; m is an integer of 4 to 50,000; and p is 0 or an integer of 1 to 10 wherein the color developer solution comprises the p-phenylenediamine color developing agents in an amount of from 1.4×10−2 to 2.5×10−2 mol/l.

6. The processing method of claim 5, wherein the photographic material comprises silver halide grain emulsions comprising silver halide grains having a chloride content of at least 90 mol %.

7. The processing method of claim 5, wherein the color developer solution comprises a sulfite of not more than $1\times10^{-2}$ mol/l.

8. The processing method of claim 5, wherein the color developer solution comprises a compound represented by the following formula (3):

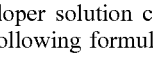

formula (3)

wherein $R_1$ is a hydrogen atom or a saturated or unsaturated aliphatic hydrocarbon group having 1 to 4 carbon atoms; $A_1$ is a saturated or unsaturated aliphatic hydrocarbon group having 2 to 4 carbon atoms; and n1 is an integer of from 1 to 200.

9. The processing method of claim 5, wherein the color developer solution comprises a compound represented by the following formula (4):

formula (4)

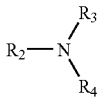

wherein $R_2$ is a hydroxyalkyl group having 2 to 6 carbon atoms; $R_3$ and $R_4$ are each a hydrogen atom, an alkyl group having 1 to 6 carbon atoms, a hydroxyalkyl group having 2 to 6 carbon atoms, a benzyl group, or

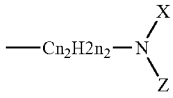

in which $n_2$ is an integer of 1 to 6, X and Y are each a hydrogen atom, an alkyl group having 1 to 6 carbon atoms or a hydroxyalkyl group having 2 to 6 carbon atoms.

* * * * *